US009229343B2

(12) United States Patent
Miyamoto

(10) Patent No.: US 9,229,343 B2
(45) Date of Patent: Jan. 5, 2016

(54) METHOD FOR PRODUCING ELECTROSTATIC LATENT IMAGE DEVELOPING TONER

(71) Applicant: KYOCERA Document Solutions Inc., Osaka (JP)

(72) Inventor: Hidetoshi Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 50 days.

(21) Appl. No.: 14/219,605

(22) Filed: Mar. 19, 2014

(65) Prior Publication Data

US 2014/0287358 A1 Sep. 25, 2014

(30) Foreign Application Priority Data

Mar. 19, 2013 (JP) ..... 2013-056871

(51) Int. Cl.

| | |
|---|---|
| ***G03G 9/00*** | (2006.01) |
| ***G03G 9/087*** | (2006.01) |
| ***G03G 9/08*** | (2006.01) |

(52) U.S. Cl.
CPC ..... *G03G 9/08755* (2013.01); *G03G 9/0804* (2013.01); *G03G 9/0806* (2013.01)

(58) Field of Classification Search
CPC ..... G03G 9/0804; G03G 9/0806
USPC ..... 430/137.14
See application file for complete search history.

(56) References Cited

U.S. PATENT DOCUMENTS

2008/0248414 A1* 10/2008 Mizuhata et al. ..... 430/109.4
2011/0269068 A1* 11/2011 Cho et al. ..... 430/137.14

FOREIGN PATENT DOCUMENTS

JP 2010-049195 A 4/2010

* cited by examiner

*Primary Examiner* — Mark A Chapman
(74) *Attorney, Agent, or Firm* — Studebaker & Baker PC

(57) ABSTRACT

In producing an electrostatic latent image developing toner, fine particle aggregates are formed by aggregating fine particles containing a binder resin and fine particles containing a release agent in an aqueous medium in the presence of an aggregating agent containing an alkali metal sulfate, and toner particles are formed by coalescing components contained in the fine particle aggregates in an aqueous medium in the presence of hydroxypropyl methyl cellulose.

4 Claims, 1 Drawing Sheet

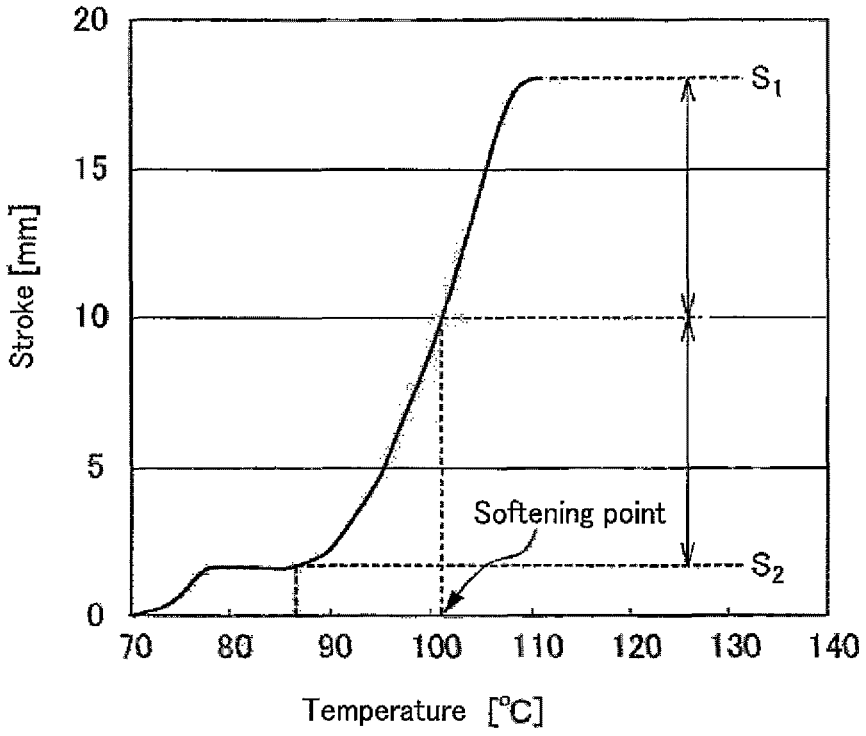
20
15
10
5
0
Stroke [mm]
70
80
90
100
110
120
130
140
Temperature [°C]
S1
S2
Softening point

METHOD FOR PRODUCING ELECTROSTATIC LATENT IMAGE DEVELOPING TONER

INCORPORATION BY REFERENCE

The present application claims priority under 35 U.S.C. §119 to Japanese Patent Application No. 2013-056871, filed on Mar. 19, 2013. The contents of this application are incorporated herein by reference in their entirety.

BACKGROUND

The present disclosure relates to a method for producing an electrostatic latent image developing toner.

In order to form images with high quality, toners are recently demanded to have a small particle size for improving resolution. For outputting an image with high quality, it is effective to reduce the average particle size of a toner to approximately 5 μm and to sharpen a particle size distribution of the toner.

A method for producing a toner having a sharp particle size distribution and having a small particle size includes an aggregation step and a coalescence step. In the aggregation step, fine particles of components of a toner, such as a binder resin, a coloring agent and a release agent, are aggregated. In the coalescence step, the aggregates obtained in the aggregation step are coalesced by heating. In such a method for producing a toner, the shapeability of a toner and the dispersibility of a component such as a coloring agent or a release agent in the toner can be easily controlled.

Specifically, in the method for producing a toner, for example, aggregates are formed and then coalesced by heating to prepare the toner. For forming the aggregates, an aggregating agent is added to a dispersion of components of the toner dispersed in an aqueous medium in the presence of a dispersant, so as to aggregate the components contained in the dispersion. Examples of the dispersant include methyl cellulose and hydroxyethyl cellulose.

SUMMARY

The present disclosure relates to a method for producing an electrostatic latent image developing toner containing a plurality of toner particles, including:

(I) aggregation of forming fine particle aggregates by aggregating fine particles containing a binder resin and fine particles containing a release agent in an aqueous medium in the presence of an aggregating agent containing an alkali metal sulfate; and (II) coalescence of forming the toner particles by coalescing components contained in the fine particle aggregates in an aqueous medium in the presence of hydroxypropyl methyl cellulose.

BRIEF DESCRIPTION OF THE DRAWINGS

FIG. 1 is a diagram illustrating a method for measuring a softening point by using an elevated flow tester.

DETAILED DESCRIPTION

An embodiment of the present disclosure will now be described in detail. It is noted that the present disclosure is not limited to the following embodiment but can be practiced with appropriate modification made within the scope of the object of the present disclosure. Incidentally, description will be appropriately omitted for avoiding redundant description, which does not limit the spirit of the disclosure.

In the present disclosure, toner particles included in an electrostatic latent image developing toner (hereinafter sometimes referred to as the toner) are produced by a production method including the following steps (I) and (II):

(I) an aggregation step of forming fine particle aggregates by aggregating fine particles containing a binder resin and fine particles containing a release agent in an aqueous medium in the presence of an aggregating agent containing an alkali metal sulfate; and (II) a coalescence step of forming the toner particles by coalescing components contained in the fine particle aggregates in an aqueous medium in the presence of hydroxypropyl methyl cellulose.

Now, toner materials used in the production of the electrostatic latent image developing toner and the method for producing the electrostatic latent image developing toner will be successively described.

<<Toner Materials>>

The toner particles included in the toner contains indispensable components (i.e., a binder resin and a release agent) and may contain an optional component (i.e., a coloring agent or a charge control agent) if necessary. The toner may contain an external additive adhered to the surface of each toner particle if necessary. The toner may be mixed with a desired carrier to be used as a two-component developer. Now, the indispensable components (i.e., the binder resin and the release agent), the optional components (i.e., the coloring agent and the charge control agent), the external additive, used in the production of the toner, and the carrier will be described one by one.

[Binder Resin]

The binder resin is not especially limited as long as it is a resin conventionally used as a binder resin for a toner. Examples of the binder resin include thermoplastic resins, such as styrene resins, (meth)acrylic resins, styrene-(meth) acrylic resins, polyethylene resins, polypropylene resins, vinyl chloride resins, polyester resins, polyamide resins, polyurethane resins, polyvinyl alcohol resins, vinyl ether resins, N-vinyl resins, and styrene-butadiene resins.

From the viewpoint of attaining a good aggregation property of the fine particles in step (I), the binder resin is preferably a resin having an acidic group such as a carboxyl group or a sulfonic group in a part of a molecular chain (specifically, at a terminal or on a side chain thereof). Examples of such a resin having an acidic group include (meth)acrylic resins, styrene-(meth)acrylic resins and polyester resins. In order to attain excellent dispersibility of a coloring agent in the toner and excellent low-temperature fixability of the toner on a recording medium, a polyester resin is more preferably used among these resins because the softening point or the glass transition point of the binder resin can be easily adjusted when a polyester resin is used.

The acid value of the binder resin having an acidic group is preferably 5 mgKOH/g or more and 40 mgKOH/g or less. If the acid value of the binder resin is too low, the aggregation of the fine particles containing the binder resin may be difficult to satisfactorily proceed depending upon the recipe employed in step (I) described later. On the other hand, if the acid value of the binder resin is too high, various performances of a resultant toner shown under a high-humidity environment may be impaired in some cases.

Now, (meth)acrylic resins, styrene-(meth)acrylic resins and polyester resins usable as the binder resin will be described.

<(Meth)acrylic Resin>

A (meth)acrylic resin is a resin obtained by copolymerizing a monomer at least including a (meth)acrylic monomer. Examples of the (meth)acrylic monomer used for preparing the (meth)acrylic resin include: (meth)acrylic acid; alkyl (meth)acrylates, such as methyl (meth)acrylate, ethyl (meth) acrylate and propyl(meth)acrylate; and (meth)acrylamide compounds, such as (meth)acrylamide, N-alkyl(meth)acrylamide, N-aryl(meth)acrylamide, N,N-dialkyl(meth)acrylamide and N,N-diaryl(meth)acrylamide. The (meth)acrylic resin preferably includes, as the acidic group, a carboxyl group contained in a (meth)acrylic acid derived monomer. In this case, the acid value of the (meth)acrylic resin can be adjusted by increasing/decreasing the amount of the (meth) acrylic acid to be used for preparing the (meth)acrylic resin.

The (meth)acrylic resin may be a resin obtained by copolymerizing a (meth)acrylic monomer and a second monomer other than the (meth)acrylic monomer. Examples of the second monomer other than the (meth)acrylic monomer include: olefins, such as ethylene, propylene, butene-1, pentene-1, hexene-1, heptene-1 and octene-1; allyl esters, such as allyl acetate, allyl benzoate, allyl acetoacetate and allyl lactate; vinyl ethers, such as hexyl vinyl ether, octyl vinyl ether, ethylhexyl vinyl ether, methoxyethyl vinyl ether, ethoxyethyl vinyl ether, chloroethyl vinyl ether, 2-ethylbutyl vinyl ether, dimethylamino ethyl vinyl ether, diethylamino ethyl vinyl ether, benzyl vinyl ether, vinyl phenyl ether, vinyl tolyl ether, vinyl chlorophenyl ether, vinyl-2,4-dichlorophenyl ether, and vinyl naphthyl ether; and vinyl esters, such as vinyl acetate, vinyl propionate, vinyl butyrate, vinyl isobutyrate, vinyl diethyl acetate, vinyl chloroacetate, vinyl methoxy acetate, vinyl butoxy acetate, vinyl phenyl acetate, vinyl acetoacetate, vinyl lactate, vinyl benzoate, vinyl salicylate, vinyl chlorobenzoate, and vinyl naphthoate.

<Styrene-(meth)acrylic Resin>

A styrene-(meth)acrylic resin is a resin obtained by copolymerizing monomers at least including a styrene monomer and a (meth)acrylic monomer. Examples of the styrene monomer used for preparing the styrene-(meth)acrylic resin include styrene, α-methyl styrene, o-methyl styrene, m-methyl styrene, p-methyl styrene, p-ethyl styrene, 2,4-dimethylstyrene, p-n-butylstyrene, p-dodecylstyrene, p-methoxystyrene, p-phenylstyrene and p-chlorostyrene.

Examples of the (meth)acrylic monomer used for preparing the styrene-(meth)acrylic resin are the same as those usable for preparing the (meth)acrylic resin described above.

The styrene-(meth)acrylic resin preferably includes, as the acidic group, a carboxyl group included in a (meth)acrylic acid-derived monomer. In this case, the acid value of the styrene-(meth)acrylic resin can be adjusted by increasing/decreasing the amount of the (meth)acrylic acid to be used for preparing the styrene-(meth)acrylic resin.

If the styrene-(meth)acrylic resin is a resin obtained by copolymerizing a styrene monomer, a (meth)acrylic monomer and a third monomer other than the styrene monomer and the (meth)acrylic monomer, examples of the third monomer are the same as those of the second monomer other than the (meth)acrylic monomer usable for preparing the (meth) acrylic resin described above.

<Polyester Resin>

A polyester resin can be a resin obtained by condensation polymerization or co-condensation polymerization of a bivalent, trivalent or more-valent alcohol component and a bivalent, trivalent or more-valent carboxylic acid component. Examples of components used in synthesizing a polyester resin include the following bivalent, trivalent or more-valent alcohol components and a bivalent, trivalent or more-valent carboxylic acid components.

Specific examples of the bivalent, trivalent or more-valent alcohol component include: diols, such as ethylene glycol, diethylene glycol, triethylene glycol, 1,2-propylene glycol, 1,3-proypylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol; bisphenols, such as bisphenol A, hydrogenated bisphenol A, polyoxyethylene bisphenol A, and polyoxypropylene bisphenol A; and trivalent or more-valent alcohols, such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the bivalent, trivalent or more-valent carboxylic acid component include: bivalent carboxylic acids, such as maleic acid, fumaric acid, citraconic acid, itaconic acid, glutaconic acid, phthalic acid, isophthalic acid, terephthalic acid, cyclohexanedicarboxylic acid, succinic acid, alkyl- or alkenyl-succinic acid (such as n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, or isododecenyl succinic acid), adipic acid, sebacic acid, azelaic acid, 1,10-decanedicarboxylic acid, and malonic acid; and trivalent or higher carboxylic acids, such as 1,2,4-benzenetricarboxylic acid (trimellitic acid), 1,2,5-benzenetricarboxylic acid, 2,5,7-naphthalenetricarboxylic acid, 1,2,4-naphthalenetricarboxyic acid, 1,2,4-butanetricarboxylic acid, 1,2,5-hexanetricarboxylic acid, 1,3-dicarboxyl-2-methyl-2-metheylenecarboxy propane, 1,2,4-cyclohexanetricarboxylic acid, tetra(methylenecarboxyl)methane, 1,2,7,8-octanetetracarboxylic acid, pyromellitic acid and Empol trimer acid. The bivalent, trivalent or more-valent carboxylic acid component may be used in the form of an ester-forming derivative, such as an acid halide, an acid anhydride or a lower alkyl ester. Here, a "lower alkyl" means an alkyl group having 1 to 6 carbon atoms.

The acid value of the polyester resin can be adjusted by adjusting balance between a hydroxyl group of an alcohol component and a carboxyl group of a carboxylic acid component used in the synthesis of the polyester resin.

The glass transition point (Tg) of the binder resin is preferably 40° C. or more and 70° C. or less. If the glass transition point of the binder resin is too low, the strength of the whole toner particles is easily lowered and hence the toner particles may aggregate under a high-temperature and high-humidity environment. If the glass transition point of the binder resin is too high, the resultant toner may be difficult to satisfactorily fix at a low temperature.

The glass transition point of the binder resin can be obtained on the basis of a change point of specific heat of the binder resin by using a differential scanning calorimeter (DSC). More specifically, the glass transition point of the binder resin can be obtained by measuring a heat absorption curve of the binder resin by using a differential scanning calorimeter ("DSC-6200" manufactured by Seiko Instruments Inc.) as a measurement apparatus. Ten mg of a measurement sample is put in an aluminum pan, and an empty aluminum pan is used as a reference. The measurement is performed under conditions of a heating rate of 10° C./min, a measurement temperature range from 25° C. to 200° C. inclusive, and under an environment of normal temperature and normal humidity. The glass transition point of the binder resin can be obtained based on a heat absorption curve of the binder resin thus obtained.

The softening point of the binder resin is preferably 150° C. or less, more preferably 80° C. or more and 140° C. or less, and particularly preferably 90° C. or more and 120° C. or less. If the softening point of the binder resin falls in this range, a toner that has excellent low-temperature fixability and is difficult to cause an offset in fixing at a high temperature can be easily produced. The softening point of the binder resin can be measured by a method described below.

<Method for Measuring Softening Point>

The softening point of the binder resin is measured by using an elevated flow tester (such as "CFT-500D" manufactured by Shimadzu Corporation). Specifically, the measurement of the softening point of a binder resin is performed as follows: A binder resin in an amount of 1.5 g is used as a sample, and a die having a height of 1.0 mm and a diameter of 1.0 mm is used. The measurement is performed under conditions of a heating rate of 4° C./min, preheating time of 300 seconds, a load of 5 kg and a measurement temperature range from 60° C. to 200° C. inclusive. On the basis of an S shaped curve pertaining to a temperature (° C.) and a stroke (mm) obtained in the measurement using the flow tester, the softening point of the binder resin is read.

A method for reading the softening point of the binder resin will be described with reference to FIG. 1. It is assumed that the maximum value of the stroke is $S_1$ and that a stroke value corresponding to a low-temperature-side base line is $S_2$. On the S shaped curve, a temperature corresponding to a stroke value of $(S_1+S_2)/2$ is regarded as the softening point of the binder resin.

The number average molecular weight (Mn) of the binder resin is preferably 3,000 or more and 20,000 or less, and more preferably 5,000 or more and 15,000 or less. The molecular weight distribution of the binder resin is preferably 2 or more and 10 or less. The molecular weight distribution is expressed as a ratio (Mw/Mn) between the number average molecular weight (Mn) and the mass average molecular weight (Mw). A toner containing a binder resin having a molecular weight distribution falling in this range can be fixed over a wide range of temperature without causing an offset, and the occurrence of an offset can be easily suppressed in using such a toner. The number average molecular weight (Mn) and the mass average molecular weight (Mw) of the binder resin can be measured by gel permeation chromatography.

[Release Agent]

For purpose of improving the fixability and the offset resistance of the toner, a release agent is contained in the toner particles. The type of release agent is not especially limited as long as it is conventionally used as a release agent for a toner.

Preferable examples of the release agent include aliphatic hydrocarbon waxes, such as low molecular weight polyethylene, low molecular weight polypropylene, polyolefin copolymers, polyolefin wax, microcrystalline wax, paraffin wax and Fischer-Tropsch wax; oxides of the aliphatic hydrocarbon waxes, such as polyethylene oxide wax and a block copolymer of polyethylene oxide wax; vegetable waxes, such as candelilla wax, carnauba wax, haze wax, jojoba wax and rice wax; animal waxes, such as beeswax, lanolin and spermaceti wax; mineral waxes, such as ozokerite, ceresin and petrolatum; waxes containing a fatty acid ester as a principal component, such as montanic acid ester wax and castor wax; and waxes obtained by deoxidizing part or whole of fatty acid ester, such as deoxidized carnauba wax.

Examples of a suitably used release agent include saturated straight chain fatty acids, such as palmitic acid, stearic acid, montanoic acid and long-chain alkyl carboxylic acids having a long-chain alkyl group; unsaturated fatty acids, such as brassidic acid, eleostearic acid and parinaric acid; saturated alcohols, such as stearyl alcohol, eicosyl alcohol, behenyl alcohol, carnaubyl alcohol, ceryl alcohol, melissyl alcohol, and long-chain alkyl alcohol having a long-chain alkyl group; polyalcohol such as sorbitol; fatty acid amides, such as linoleic acid amide, oleic acid amide and lauric acid amide; saturated fatty acid bisamides, such as methylene bis-stearic acid amide, ethylene bis-capric acid amide, ethylene bis-lauric acid amide, and hexamethylene bis-stearic acid amide; unsaturated fatty acid amides, such as ethylene bis-oleic acid amide, hexamethylene bis-oleic acid amide, N,N'-dioleyladipic acid amide, and N,N'-dioleylsebasic acid amide; aromatic bisamides, such as m-xylene bis-stearic acid amide and N,N'-distearyl isophthalic acid amide; fatty acid metal salts, such as calcium stearate, calcium laurate, zinc stearate and magnesium stearate; waxes obtained by grafting a vinyl monomer, such as styrene or acrylic acid, onto aliphatic hydrocarbon waxes; partially esterified products of fatty acid, such as behenic acid monoglyceride, and polyalcohol; and methyl ester compounds having a hydroxyl group obtained by hydrogenating vegetable fats and oils.

The amount of the release agent to be used is preferably 1 part by mass or more and 20 parts by mass or less, and more preferably 5 parts by mass or more and 15 parts by mass or less based on 100 parts by mass of the binder resin. If an image is formed by using a toner containing the release agent in an excessively small amount, an offset or image smearing is easily caused in the formed image. If the amount of the release agent is excessively large, toner particles may be fused with each other to degrade the storage stability of the toner. According to a method for producing an electrostatic latent image developing toner described later, even if the release agent is used in a large amount, coming off of the release agent from the surfaces of toner particles and exudation of the release agent from the inside of the toner particles can be suppressed. Accordingly, a toner good in both the low-temperature fixability and the high-temperature storage resistance can be easily obtained.

[Coloring Agent]

The toner particles included in the toner of the present disclosure may contain a coloring agent. The coloring agent that may be contained in the toner can be appropriately selected in accordance with the color of the toner particles from known pigments and dyes. Specific examples of a suitably used coloring agent include the following:

An example of a black coloring agent includes carbon black. A coloring agent whose color is adjusted to black by using coloring agents such as a yellow coloring agent, a magenta coloring agent and a cyan coloring agent described later may be used as the black coloring agent. Examples of a coloring agent for a color toner include a yellow coloring agent, a magenta coloring agent and a cyan coloring agent.

Examples of the yellow coloring agent include condensed azo compounds, isoindolinone compounds, anthraquinone compounds, azo metal complexes, methine compounds and allylamide compounds. A specific example includes C.I Pigment Yellow (12, 13, 14, 15, 17, 62, 74, 83, 93, 94, 95, 97, 109, 110, 111, 120, 127, 128, 129, 147, 151, 154, 155, 168, 174, 175, 176, 180, 181, 191 or 194).

Examples of the magenta coloring agent include condensed azo compounds, diketopyrrolopyrrole compounds, anthraquinone compounds, quinacridone compounds, basic dye lake compounds, naphthol compounds, benzimidazolone compounds, thioindigo compounds and perylene compounds. A specific example includes C.I Pigment Red (2, 3, 5, 6, 7, 19, 23, 48:2, 48:3, 48:4, 57:1 81:1, 122, 144, 146, 150, 166, 169, 177, 184, 185, 202, 206, 220, 221 or 254).

Examples of the cyan coloring agent include copper phthalocyanine compounds, copper phthalocyanine derivatives, anthraquinone compounds and basic dye lake compounds. A specific example includes C.I. Pigment Blue (1, 7, 15, 15:1, 15:2, 15:3, 15:4, 60, 62 or 66).

One of these coloring agents can be singly used, or two or more of these can be used in combination. The amount of the coloring agent to be used is preferably 1 part by mass or more and 10 parts by mass or less based on 100 parts by mass of the binder resin.

[Charge Control Agent]

The toner particles included in the toner of the present disclosure may contain a charge control agent if necessary. The charge control agent is used for purpose of improving the stability in charge level of a toner or the charge rising property of the toner, so as to obtain a toner excellent in the durability or the stability. The charge rising property of a toner is an index whether or not the toner can be charged to prescribed charge level in a short period of time. If development is performed with the toner positively charged, a positively chargeable charge control agent is used. If the development is performed with the toner negatively charged, a negatively chargeable charge control agent is used.

The type of charge control agent can be appropriately selected from charge control agents conventionally used for a toner. Specific examples of the positively chargeable charge control agent include: azine compounds, such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline and quinoxaline; direct dyes made of an azine compound, such as azine fast red FC, azine fast red 12BK, azine violet BO, azine brown 3G, azine light brown GR, azine dark green BH/C, azine deep black EW, and azine deep black 3RL; nigrosine compounds, such as nigrosine, nigrosine salts and nigrosine derivatives; acidic dyes made of a nigrosine compound, such as nigrosine BK, nigrosine NB and nigrosine Z; metal salts of naphthenic acid or higher fatty acid; alkoxylated amine; alkyl amide; and quaternary ammonium salts, such as benzylmethylhexyldecyl ammonium and decyl trimethyl ammonium chloride. Among these positively chargeable charge control agents, nigrosine compounds are preferably used because a rapider charge rising property of the toner can be attained by them. One of these positively chargeable charge control agents may be singly used, or two or more of these may be used in combination.

A resin having a quaternary ammonium salt, a carboxylate or a carboxyl group can be used as the positively chargeable charge control agent. Specific examples of such a resin include styrene resins having a quaternary ammonium salt, acrylic resins having a quaternary ammonium salt, styrene acrylic resins having a quaternary ammonium salt, polyester resins having a quaternary ammonium salt, styrene resins having a carboxylate, acrylic resins having a carboxylate, styrene acrylic resins having a carboxylate, polyester resins having a carboxylate, styrene resins having a carboxyl group, acrylic resins having a carboxyl group, styrene acrylic resins having a carboxyl group, and polyester resins having a carboxyl group. Such a resin may be an oligomer or a polymer.

Specific examples of the negatively chargeable charge control agent include organic metal complexes and chelate compounds. As the organic metal complexes and the chelate compounds, acetylacetone metal complexes, such as aluminum acetyl acetonate and iron (II) acetyl acetonate; salicylic acid metal complexes and salicylic acid metal salts, such as chromium 3,5-di-tert-butylsalicylate, are preferably used, and the salicylic acid metal complexes and salicylic acid metal salts are more preferably used. One of these negatively chargeable charge control agents may be singly used, or two or more of these may be used in combination.

The amount of the positively chargeable or negatively chargeable charge control agent to be used is preferably 0.5 part by mass or more and 15 parts by mass or less, more preferably 1.0 part by mass or more and 8.0 parts by mass or less, and particularly preferably 3.0 parts by mass or more and 7.0 parts by mass or less based on 100 parts by mass of the whole amount of the toner.

[External Additive]

The surface of each toner particle included in the toner of the present disclosure may be treated with an external additive if necessary. In the present specification and appended claims, a toner particle prior to the treatment with an external additive is sometimes designated as a "toner mother particle".

Specific examples of a suitably used external additive include silica and metal oxides (such as alumina, titanium oxide, magnesium oxide, zinc oxide, strontium titanate and barium titanate). One of these external additives may be singly used, or two or more of these may be used in combination.

The particle size of the external additive is preferably 0.01 μm or more and 1.0 μm or less. The amount of the external additive to be used is preferably 0.1 part by mass or more and 10 parts by mass or less, and more preferably 0.2 part by mass or more and 5 parts by mass or less based on 100 parts by mass of the toner mother particle.

[Carrier]

The toner may be mixed with a desired carrier so as to be used as a two-component developer. In preparing a two-component developer, a magnetic carrier is preferably used.

An example of a suitably used carrier includes one obtained by coating a carrier core with a resin. Examples of the carrier core include: a particle of a metal such as iron, oxidized iron, reduced iron, magnetite, copper, silicon steel, ferrite, nickel or cobalt; a particle of an alloy of such a material and a metal such as manganese, zinc or aluminum; a particle of an iron alloy such as an iron-nickel alloy or an iron-cobalt alloy; a particle of a ceramic such as titanium oxide, aluminum oxide, copper oxide, magnesium oxide, lead oxide, zirconium oxide, silicon carbide, magnesium titanate, barium titanate, lithium titanate, lead titanate, lead zirconate or lithium niobate; a particle of a high-dielectric constant material such as ammonium dihydrogen phosphate, potassium dihydrogen phosphate or Rochelle salt; and a resin carrier containing any of these magnetic particles dispersed in a resin.

Specific examples of the resin coating the carrier core include (meth)acrylic polymers, styrene polymers, styrene-(meth)acrylic copolymers, olefin polymers (such as polyethylene, chlorinated polyethylene and polypropylene), polyvinyl chloride, polyvinyl acetate, polycarbonate resins, cellulose resins, polyester resins, unsaturated polyester resins, polyamide resins, polyurethane resins, epoxy resins, silicone resins, fluorine resins (such as polytetrafluoroethylene, polychlorotrifluoroethylene and polyvinylidene fluoride), phenol resins, xylene resins, diallyl phthalate resins, polyacetal resins and amino resins. One of these resins may be singly used, or two or more of these resins may be used in combination.

The carrier has a particle size of preferably 20 μm or more and 120 μm or less, and more preferably 25 μm or more and 80 μm or less. Incidentally, the particle size of the carrier is measured by using an electron microscope.

If the toner is used as a two-component developer, the content of the toner is preferably 3% by mass or more and 20% by mass or less, and more preferably 5% by mass or more and 15% by mass or less based on the whole mass of the two-component developer.

The toner materials described so far are used for producing the electrostatic latent image developing toner by a method described below.

<<Method for Producing Electrostatic Latent Image Developing Toner>>

The electrostatic latent image developing toner (toner particles) of the present disclosure is produced by a method including the following steps (I) and (II):

(I) an aggregation step of forming fine particle aggregates by aggregating fine particles containing a binder resin and fine particles containing a release agent in an aqueous medium in the presence of an aggregating agent containing an alkali metal sulfate; and (II) a coalescence step of forming the toner particles by coalescing components contained in the fine particle aggregates in an aqueous medium in the presence of hydroxypropyl methyl cellulose.

If the toner is produced by the method including the above-described steps (I) and (II), even when a large amount of release agent is contained in the toner, the exudation of the release agent from the toner and/or coming off of the release agent from the toner surface can be suppressed. Therefore, according to the method for producing an electrostatic latent image developing toner of the present disclosure, an electrostatic latent image developing toner excellent in the low-temperature fixability and the high-temperature storage stability can be produced.

The toner production method may include, in addition to steps (I) and (II), the following steps (III) to (V) if necessary:

Step (III): a washing step of washing the coalesced particles obtained in step (II);

step (IV): a drying step of drying the coalesced particles having been washed in step (III); and step (V): an external addition step of adhering an external additive to the surfaces of the coalesced particles (toner mother particles).

Now, steps (I) to (V) will be described one by one.

[Step (I): Aggregation Step]

In step (I), fine particles containing a binder resin and fine particles containing a release agent are aggregated in an aqueous medium in the presence of an aggregating agent containing an alkali metal sulfate, so as to form fine particle aggregates. A method for forming the fine particle aggregates is not especially limited and may be appropriately selected from known methods. The fine particles containing a binder resin and the fine particles containing a release agent are preferably prepared as aqueous medium dispersions of fine particles respectively formed through micronization, into a desired particle size, of these components or compositions containing these components. In aggregating the fine particles, fine particles containing a coloring agent may be preferably used, if necessary, in addition to the fine particles containing a binder resin and the fine particles containing a release agent.

Now, a method for preparing the fine particles containing a binder resin, a method for preparing the fine particles containing a release agent, a method for preparing the fine particles containing a coloring agent, and the method for aggregating the fine particles will be described in this order.

[Method for Preparing Fine Particles Containing Binder Resin]

The method for preparing fine particles containing a binder resin is not especially limited. The fine particles containing a binder resin may be either fine particles containing a binder resin or fine particles of a binder resin composition containing an indispensable component (i.e., a binder resin) and optional components (i.e., a coloring agent and a charge control agent). In general, the fine particles containing a binder resin are prepared as an aqueous medium dispersion of fine particles containing a binder resin by micronizing, in an aqueous medium, a binder resin or a binder resin composition containing the optional components (i.e., a coloring agent and charge control agent) other than the binder resin into a desired size. A method for preparing the aqueous medium dispersion of fine particles containing a binder resin will now be described.

First, a binder resin is coarsely pulverized into a particle size of preferably 30 μm or less by using a pulverizer (such as a cutter mill, a feather mill or a jet mill) The coarsely pulverized product is heated, in a state dispersed in an aqueous medium such as ion-exchanged water, to a temperature equal to or higher, by 10° C. or more, than the softening point of the binder resin measured by a flow tester (specifically, to a temperature as high as approximately 200° C. at the most). To the thus heated aqueous medium dispersion containing the binder resin, a strong shearing force is applied by using a homogenizer or a pressure-ejecting type disperser, and thus, the aqueous medium dispersion of fine particles containing the binder resin can be obtained.

As the binder resin, a (meth)acrylic resin or a styrene-(meth)acrylic resin may be used. In this case, the fine particles containing the binder resin can be prepared also by employing emulsion polymerization. The emulsion polymerization is a method for forming resin fine particles by polymerizing (meth)acrylic resin monomers and styrene-(meth)acrylic resin monomers respectively having prescribed compositions in an aqueous medium by a known method.

If the fine particles containing a binder resin are fine particles of a binder resin composition containing the binder resin and optional components (i.e., a coloring agent and a charge control agent), the binder resin and the optional components (the coloring agent and the charge control agent) are first mixed by using a mixer (such as a Henschel mixer (manufactured by Mitsui Mining Co., Ltd.)). The thus obtained mixture is then melt kneaded by using a kneader (such as a twin screw extruder, a three-roll kneader or a two-roll kneader) to give a binder resin composition. The resulting binder resin composition is cooled and then coarsely pulverized into a particle size of preferably 30 μm or less by using a pulverizer (such as a cutter mill, a feather mill or a jet mill) The thus obtained coarsely pulverized product of the binder resin composition is heated, in a state dispersed in an aqueous medium, to a temperature equal to or higher, by 10° C. or more, than the softening point of the binder resin measured by using a flow tester. To the thus heated aqueous medium dispersion containing the binder resin composition, a strong shearing force is applied by using a homogenizer or a pressure-ejecting type disperser, and thus, an aqueous medium dispersion of binder resin composition fine particles is obtained.

An apparatus for applying a strong shearing force to the aqueous medium dispersion is, for example, NANO3000 (manufactured by Beryu Co., Ltd.), Nanomizer (manufactured by Yoshida Kikai Co., Ltd.), Microfluidizer (manufactured by MFI), Gaulin Homogenizer (manufactured by Manton Gaulin), or Clearmix (manufactured by M Technique Co., Ltd.).

(Aqueous Medium)

The aqueous medium is not especially limited as long as it is a liquid medium containing water as a principal component, and can be appropriately selected from tap water, industrial water, distilled water and ion-exchanged water.

(Organic Solvent)

The aqueous medium may contain an organic solvent. If the aqueous medium contains an organic solvent, the amount of the organic solvent to be used is preferably 20% by mass or less, more preferably 10% by mass or less, and particularly preferably 5% by mass or less based on the mass of the aqueous medium. Examples of the organic solvent that may be contained in the aqueous medium include alcohols such as methanol and ethanol; ethers such as tetrahydrofuran; ketones such as acetone; and nitrogen-containing polar organic solvents such as N,N-dimethylformamide, N,N-dimethylacetamide and N-methyl-2-pyrrolidone.

(Surfactant)

The aqueous medium preferably contains a surfactant. If a surfactant is added to the aqueous medium, the micronization of the binder resin or the binder resin composition can be allowed to satisfactorily proceed, so that an aqueous medium dispersion of the fine particles having excellent dispersion stability can be easily obtained.

The amount of the surfactant to be used based on the amount of the binder resin or the binder resin composition varies depending upon an apparatus used for preparing the fine particles, and is preferably 1 part by mass or more and 5 parts by mass or less, and more preferably 2 parts by mass or more and 4 parts by mass or less based on 100 parts by mass of the binder resin or the binder resin composition.

The surfactant to be used in preparation of the fine particles in the aqueous medium is not especially limited but appropriately selected from the group consisting of an anionic surfactant, a cationic surfactant and a nonionic surfactant. Examples of the anionic surfactant include a sulfuric acid ester salt type surfactant, a sulfonic acid salt type surfactant, and soap. Examples of the cationic surfactant include an amine salt type surfactant and a quaternary ammonium salt type surfactant. Examples of the nonionic surfactant include a polyethylene glycol type surfactant, an alkylphenol ethylene oxide addition product type surfactant and a polyalcohol type surfactant that is a derivative of polyalcohol (such as glycerin, sorbitol or sorbitan). Among these surfactants, at least one of the anionic surfactant and the nonionic surfactant is preferably used. One of the aforementioned surfactants may be singly used, or two or more of these surfactants may be used in combination.

If a surfactant is used, the concentration of the surfactant in the aqueous medium is preferably 0.5% by mass or more and 5.0% by mass or less.

(Basic Substance)

In the preparation of the fine particles containing a binder resin, a basic substance is preferably added to the aqueous medium. In the case where the binder resin is a resin having an acidic group, if the binder resin is directly micronized in the aqueous medium, the specific surface area of the binder resin is increased, and hence, the number of acidic groups exposed on the surfaces of the fine particles is increased, which may lower the pH of the aqueous medium to approximately 3 or more and 4 or less. In this case, it is apprehended that the binder resin may be degraded through hydrolysis or that fine particles having a desired particle size may be difficult to obtain.

In order to suppress this apprehension, a basic substance is preferably added to the aqueous medium in preparing the fine particles containing a binder resin. Specific examples of the basic substance include alkali metal hydroxides, such as sodium hydroxide, potassium hydroxide and lithium hydroxide; alkali metal carbonates, such as sodium carbonate and potassium carbonate; alkali metal hydrogencarbonates, such as sodium hydrogencarbonate and potassium hydrogencarbonate; and nitrogen-containing organic bases, such as N,N-dimethylethanolamine, N,N-diethylethanolamine, triethanolamine, tripropanolamine, tributanolamine, triethylamine, n-propylamine, n-butylamine, isopropylamine, monomethanolamine, morpholine, methoxypropylamine, pyridine and vinyl pyridine.

As another method for preparing the aqueous medium dispersion, a solution of a binder resin or a binder resin composition dissolved in a suitable solvent may be dispersed and dispersion emulsified in an aqueous medium containing a surfactant by using an emulsifier such as a homogenizer. Thereafter, the thus obtained emulsion is subjected to desolvation, and thus, the aqueous medium dispersion of the fine particles containing the binder resin can be prepared.

Alternatively, so-called phase inversion emulsification may be also employed for preparing the fine particles containing a binder resin. Specifically, the fine particles containing a binder resin can be obtained as follows:

First, a basic substance is added, for neutralization, to a solution of a binder resin or a binder resin composition dissolved in a suitable solvent. The phase inversion is caused by adding water to the neutralized solution, followed by desolvation under heating and stirring. In this manner, an aqueous medium dispersion of fine particles containing the binder resin or the binder resin composition can be prepared.

The volume average particle size ($D_{50}$) of the fine particles containing the binder resin or the fine particles containing the binder resin composition prepared as described above is preferably 1 μm or less, and more preferably 0.1 μm or more and 0.8 μm or less. If the volume average particle size ($D_{50}$) of the fine particles containing the binder resin or the binder resin composition falls in this range, an electrostatic latent image developing toner having uniform particle shape and a sharp particle size distribution can be easily prepared. As a result, the performance and the productivity of the toner can be stabilized. The volume average particle size ($D_{50}$) of the fine particles can be measured by using a laser diffraction/scattering particle size distribution analyzer (Partica LA-950V2 (manufactured by Horiba Ltd.)).

The method for preparing the fine particles containing a binder resin has been described so far, and fine particles containing a binder resin and a coloring agent can be similarly prepared except that a component to be mixed with the binder resin is changed.

[Method for Preparing Fine Particles Containing Release Agent]

In the same manner as in the method for preparing the fine particles containing a binder resin, the fine particles containing a release agent are generally prepared as an aqueous medium dispersion of the fine particles containing a release agent by micronizing, in an aqueous medium, the release agent into a desired particle size. A method for preparing the aqueous medium dispersion of the fine particles containing a release agent will now be described.

A release agent is precedently coarsely pulverized to particles having a particle size of approximately 100 μm or less. Subsequently, the coarsely pulverized product of the release agent is added to an aqueous medium containing a surfactant to give a slurry. The thus obtained slurry is heated to a temperature equal to or higher than the melting point of the release agent. As the surfactant, a surfactant similar to that used in the preparation of the fine particles containing a binder resin can be used. To the heated slurry, a strong shearing force is applied by using a homogenizer or a pressure-ejecting type disperser, and thus, an aqueous medium dispersion of fine particles containing the release agent is prepared. As an apparatus used for applying a strong shearing force in the preparation of the aqueous medium dispersion of the fine particles containing the release agent, an apparatus similar to that used for applying a strong shearing force in the preparation of the aqueous medium dispersion of the binder resin composition fine particles can be used.

Most of release agents generally have a melting point of 100° C. or lower, and in this case, such a release agent can be micronized by heating to a temperature equal to or higher than its melting point under atmospheric pressure and by using a general apparatus for applying a strong shearing force to an aqueous medium dispersion. If the melting point of the release agent exceeds 100° C., the release agent can be micronized by using a pressure resistant apparatus.

The volume average particle size ($D_{50}$) of the fine particles containing the release agent is preferably 1 μm or less, and more preferably 0.1 μm or more and 0.6 μm or less. The volume average particle size ($D_{50}$) of the fine particles containing the release agent can be measured by using a laser diffraction/scattering particle size distribution analyzer (Partica LA-950V2 (manufactured by Horiba Ltd.)).

[Method for Preparing Fine Particles Containing Coloring Agent]

Fine particles containing a coloring agent can be obtained by dispersing, by using a known disperser, a coloring agent, and an additive for a coloring agent such as a surfactant if necessary, in an aqueous medium containing a surfactant. The type of the surfactant is not especially limited, and any of an anionic surfactant, a cationic surfactant and a nonionic surfactant may be used. The amount of the surfactant to be used is not especially limited, and is preferably equal to or larger than a critical micelle concentration (CMC).

The disperser used for dispersing the coloring agent is not especially limited, and for example, a pressure disperser (such as a mechanical homogenizer, Manton Gaulin or a pressure homogenizer), a medium type disperser (such as an Ultra Apex Mill, a sand grinder, a Getzmann Mill or a Diamond Fine Mill) or an ultrasonic disperser can be used.

The volume average particle size ($D_{50}$) of the fine particles containing the coloring agent is preferably 0.05 μm or more and 0.2 μm or less.

[Method for Aggregating Fine Particles]

The respective fine particles prepared as described above are combined appropriately for forming fine particle aggregates, so that the resultant toner can contain prescribed components, and the fine particle aggregates are coalesced to obtain toner particles. In the production method of the present disclosure, the fine particles are aggregated in the presence of an aggregating agent containing an alkali metal sulfate to form the fine particle aggregates.

(Alkali Metal Sulfate)

In the aggregation step, an aggregating agent containing an alkali metal sulfate is used. If the fine particles are aggregated in the presence of the alkali metal sulfate, the gelling temperature of an aqueous medium can be lowered in the coalescence step performed after the aggregation step. As described later, gelation of the aqueous medium can suppress excessive aggregation of the fine particle aggregates, exudation of the release agent from the fine particle aggregates or coming off of the release agent from the surfaces of the fine particle aggregates. Therefore, if the gelling temperature of the aqueous medium is lowered, excessive aggregation of the fine particle aggregates, exudation of the release agent from the fine particle aggregates or coming off of the release agent from the surfaces of the fine particle aggregates can be suppressed even when a toner is prepared by using a release agent having a melting point lower than that of a release agent conventionally used for a toner. Accordingly, if a toner is produced by the production method of the present disclosure, a toner excellent in the low-temperature fixability can be easily produced.

As the alkali metal sulfate, sodium sulfate or a potassium sulfate is preferably used, and sodium sulfate is more preferably used. As the aggregating agent, a second aggregating agent other than an alkali metal sulfate can be used together with the alkali metal sulfate. Examples of the second aggregating agent other than the alkali metal sulfate include inorganic metal salts other than the alkali metal sulfate, inorganic ammonium salts, and bivalent or higher metal complexes. The content of the alkali metal sulfate in the aggregating agent is preferably 80% by mass or more, more preferably 90% by mass or more, and particularly preferably 100% by mass.

The amount of the aggregating agent to be used is preferably 0.1% by mass or more and 10.0% by mass or less, and more preferably 0.5% by mass or more and 5.0% by mass or less. The amount of use of the aggregating agent is preferably appropriately adjusted in accordance with the type and amount of the surfactant contained in the aqueous medium dispersion of the fine particles.

The condition for adding the aggregating agent is not especially limited as long as the aggregation of the fine particles satisfactorily proceeds. The aggregating agent is added preferably after adjusting the pH of the aqueous medium dispersion of the fine particles as occasion demands and at a temperature equal to or lower than the glass transition point of the binder resin. If a polyester resin is used as the binder resin, the aqueous medium dispersion containing the fine particles is adjusted preferably to pH 7 or more, and more preferably to pH 10 or more. If the aggregating agent is added after adjusting the dispersion to a more alkaline pH, the fine particles can be homogeneously aggregated, and the resultant toner can attain a sharp particle size distribution. The aggregating agent may be added all at once or gradually.

After the aggregation is allowed to proceed until fine particle aggregates having a desired particle size are formed, an aggregation terminator is preferably added. Examples of the aggregation terminator include sodium chloride and sodium hydroxide. In this manner, fine particle aggregates having a desired particle size can be produced in the aqueous medium.

[Step (II): Coalescence Step]

In step (II), the components contained in the fine particle aggregates obtained as described above are coalesced in the aqueous medium in the presence of hydroxypropyl methyl cellulose. In the coalescence step, the aqueous medium dispersion containing the fine particle aggregates is heated to coalesce the components contained in the fine particle aggregates, so as to obtain an aqueous medium dispersion containing toner particles having a desired particle size. The temperature for heating the aqueous medium dispersion containing the fine particle aggregates is preferably equal to or higher, by 10° C. or more, than the glass transition point (Tg) of the binder resin and equal to or lower than the softening point of the binder resin. If the aqueous medium dispersion containing the fine particle aggregates is heated to such a temperature, coalescence of the components contained in the fine particle aggregates can be allowed to excellently proceed.

By heating the fine particle aggregates, the shapes of the fine particle aggregates gradually become spherical. The sphericity of the fine particle aggregates can be controlled to a desired value by controlling the heating temperature and time. This is because the melting viscosity of the binder resin is lowered as the temperature increases and the shapes of the fine particle aggregates are changed to be spherical due to their surface tension.

The average roundness of the toner particles attained after the coalescence is preferably 0.965 or more and 0.985 or less. The average roundness of the toner particles can be measured by the following method.

<Method for Measuring Average Roundness>

The average roundness of the toner particles is measured by using a flow particle image analyzer (such as FPIA-3000 (manufactured by Sysmex Corporation)). Under a measurement environment of 23° C. and 60% RH, each of toner particles having an equivalent circle diameter of 0.60 μm or more and 400 μm or less is measured for a length ($L_0$) of the circumference of a circle having the same projected area as the particle image of the toner particle and a length (L) of the outer periphery of the projected image of the toner particle, and the roundness (a) of the toner particle is obtained in accordance with a formula below. A value obtained by dividing the sum of the roundnesses of the measured toner particles by the number of the measured toner particles is defined as the average roundness.

$$\text{Roundness } a = L_0/L \qquad \text{(Roundness calculation formula)}$$

(Hydroxypropyl Methyl Cellulose)

The hydroxypropyl methyl cellulose used in the coalescence step of coalescing the fine particle aggregates is a derivative of cellulose, in which a part of a hydroxyl group (—OH) of cellulose is substituted by a methoxy group and a hydroxypropoxy group. Therefore, while cellulose is insoluble in water, hydroxypropyl methyl cellulose is easily soluble in water at room temperature and normal pressure. When the hydroxypropyl methyl cellulose contained in an aqueous medium is heated, a crosslinking point between molecules of the hydroxypropyl methyl cellulose is formed in a position where substituents are present in a high density in the molecules of the hydroxypropyl methyl cellulose. When a crosslinking point is formed between the molecules of the hydroxypropyl methyl cellulose, the aqueous medium is gelled. When the aqueous medium is gelled, the excessive aggregation of the fine particle aggregates, the exudation of the release agent from the fine particle aggregates or the coming off of the release agent from the surfaces of the fine particle aggregates can be suppressed. The ability of forming a crosslinking point between the molecules of the hydroxypropyl methyl cellulose is lowered by cooling the heated aqueous medium to room temperature. When the ability of forming a crosslinking point between the molecules of the hydroxypropyl methyl cellulose is lowered, the viscosity of the heated aqueous medium can be restored to the viscosity thereof shown before the heating, and therefore, the toner particles alone can be easily separated from the aqueous medium.

In the hydroxypropyl methyl cellulose, a degree of substitution with methoxy groups ($DS_m$) is preferably 1.4 or more and 1.9 or less, and moles of substitution of hydroxypropoxy groups ($MS_{hp}$) is preferably 0.15 or more. The degree of substitution with methoxy groups ($DS_m$) refers to an average number of hydroxy groups substituted per glucose ring unit contained in cellulose, and the moles of substitution of hydroxypropoxy groups ($MS_{hp}$) refers to an average number of moles of hydroxypropoxy groups added per glucose ring unit contained in cellulose. If the degree of substitution ($DS_m$) and the moles of substitution ($MS_{hp}$) have values within these ranges, the hydroxypropyl methyl cellulose is easily dissolved in an aqueous medium.

The hydroxypropyl methyl cellulose may be either a commercially available product or a synthesized product. Examples of the commercially available product of the hydroxypropyl methyl cellulose include Metolose 65SH-50 (manufactured by Shin-Etsu Chemical Co., Ltd., having $DS_m$ of 1.8 and $MS_{hp}$ of 0.15), Metolose 60SH-50 (manufactured by Shin-Etsu Chemical Co., Ltd., having $DS_m$ of 1.9 and $MS_{hp}$ of 0.25) and Metolose 90SH-100 (manufactured by Shin-Etsu Chemical Co., Ltd., having $DS_m$ of 1.4 and $MS_{hp}$ of 0.20).

The hydroxypropyl methyl cellulose is synthesized, for example, as follows: First, cotton linter or wood pulp is treated with sodium hydroxide to give alkali cellulose. The alkali cellulose is reacted with a methylating agent such as methyl chloride or methyl iodide to give methyl cellulose. Propylene oxide is allowed to act on the thus obtained methyl cellulose to give hydroxypropyl methyl cellulose. The propylene oxide may be allowed to act on the alkali cellulose before or simultaneously with the methylation.

The amount of the hydroxypropyl methyl cellulose to be used is preferably such an amount that the concentration of the hydroxypropyl methyl cellulose in the aqueous medium in which the fine particle aggregates are coalesced can be 0.5% by mass or more and 5.0% by mass or less based on the mass of liquid components (i.e., the surfactant+the aqueous medium+the hydroxypropyl methyl cellulose) contained in the aqueous medium dispersion in which the fine particle aggregates are formed.

The hydroxypropyl methyl cellulose may be precedently contained in the aqueous medium in which the fine particle aggregates are formed or in the aqueous medium dispersion of the fine particles containing the release agent. In this case, the hydroxypropyl methyl cellulose is precedently contained preferably in the aqueous medium dispersion of the fine particles containing the release agent. This is because the aqueous medium used for forming the fine particle aggregates contains an alkali metal sulfate and the hydroxypropyl methyl cellulose may be difficult to dissolve in an aqueous medium containing an alkali metal sulfate.

[Step (III)]

The coalesced particles obtained in step (II) are washed with water if necessary. A method for washing the particles is not especially limited, and the coalesced particles are collected in the form of a wet cake from the dispersion of the coalesced particles through solid-liquid separation. The washing is performed by, for example, a method in which the collected wet cake is washed with water, or a method in which the coalesced particles are settled in the dispersion of the coalesced particles, a supernatant is replaced with water, and the coalesced particles are dispersed in water again after the replacement.

[Step (IV)]

The coalesced particles obtained in step (II) are dried if necessary. A method for drying the coalesced particles is not especially limited. The drying is suitably performed by, for example, a method using a drier (such as a spray drier, a fluid bed drier, a vacuum-freeze drier or a vacuum drier). Especially, a spray drier is more preferably used because aggregation of the coalesced particles can be easily suppressed during the drying using a spray drier. In using a spray drier, if a dispersion of an external additive such as silica is sprayed together with the dispersion of the coalesced particles, toner particles having the external additive on surfaces of the coalesced particles (toner mother particles) can be obtained. The coalesced particles thus dried can be used as toner mother particles to be subjected to a treatment with an external additive in step (V).

[Step (V)]

In step (V), an external additive is adhered to the surfaces of the toner mother particles. A method for adhering an external additive to the surfaces of the toner mother particles is not especially limited. As a suitable method, an external additive is mixed with the toner mother particles by using a mixer (such as a Henschel mixer or a Nauta mixer) with conditions adjusted so that the external additive cannot be embedded in surface portions of the toner mother particle.

As described so far, according to the present disclosure, a method for producing a toner excellent in the low-temperature fixability and the high-temperature storage stability is provided. An electrostatic latent image developing toner produced by the method of the present disclosure is suitably used in a variety of image forming apparatuses.

EXAMPLES

The present disclosure will now be more specifically described with reference to examples. It is noted that the present disclosure is not limited to the scope of the following examples.

Preparation Example 1

[Preparation of Polyester Resins a to c]

Polyester resins a to c were prepared by a method described below. The following monomers a to d were used for the preparation of the polyester resins a to c:

Monomer a: 2,2-bis(4-hydroxyphenyl)propane (ethylene oxide 2-mole addition product)

Monomer b: 2,2-bis(4-hydroxyphenyl)propane (propylene oxide 2-mole addition product)

Monomer c: terephthalic acid

Monomer d: trimellitic acid

The monomers a to c in amounts shown in Table 1 were put in a reaction vessel equipped with a condenser tube, a thermometer, a stirrer and a nitrogen introducing tube. The reaction vessel was placed on a mantle heater, and a nitrogen gas was introduced into the reaction vessel through the nitrogen introducing tube, so as to establish an inert atmosphere within the reaction vessel. Subsequently, with stirring the mixture of the monomers, the temperature of the contents of the reaction vessel was increased to 230° C., and a polymerization reaction was performed for 5 hours with produced water distilled off under continuous stirring at the same temperature. Thereafter, the pressure within the reaction vessel was reduced to 5 to 20 mmHg, and a reaction was performed with stirring the contents in the reaction vessel until the acid value of a solid content of the contents of the reaction vessel became 2 mgKOH/g or less, and then, the contents of the reaction vessel were cooled to 180° C. After cooling, the monomer d in an amount shown in Table 1 was added to the reaction vessel under stirring of the contents in the reaction vessel at the same temperature, and a reaction was performed for 2 hours at normal pressure in a hermetic environment. Thereafter, the contents of the reaction vessel were taken out to a stainless steel vat to cool to room temperature. In this manner, each of polyester resins having physical properties shown in Table 1 was obtained. Incidentally, each of the thus obtained polyester resins was pulverized into fine particles priorly to preparation of a colored resin fine particle dispersion described below.

TABLE 1

| | Polyester resin | | |
|---|---|---|---|
| | a | b | c |
| Monomer composition [mol (parts by mass)] | | | |
| Monomer a | 1.30 (379) | 1.30 | 1.30 |
| Monomer b | 1.30 (447) | 1.30 | 1.30 |
| Monomer c | 2.00 (332) | 2.00 | 2.00 |
| Monomer d | 0.21 (40.0) | 0.15 (28.6) | 0.25 (47.6) |
| Physical properties | | | |
| Number average molecular weight (Mn) | 2,500 | 2,600 | 2,300 |
| Mass average molecular weight (Mw) | 6,500 | 7,000 | 6,000 |
| Molecular weight distribution (Mw/Mn) | 2.60 | 2.69 | 2.61 |
| Softening point (Tm) [° C.] | 91 | 93 | 89 |
| Glass transition point (Tg) [° C.] | 51 | 52 | 51 |
| Acid value [mgKOH/g] | 15.5 | 10.4 | 28.9 |

Examples 1 to 13 and Comparative Examples 1 to 4

(Preparation of Colored Resin Fine Particle Dispersions A to C)

An aqueous medium dispersion of colored resin fine particles containing a binder resin and a coloring agent was prepared by a method described below.

A thousand parts by mass of the binder resin, that is, a corresponding one of the polyester resins prepared in Preparation Example 1 of a type shown in Table 2, and 50 parts by mass of a coloring agent (a cyan pigment (copper phthalocyanine), C.I. Pigment Blue 15-3 (manufactured by Dainichiseika Color & Chemicals Mfg. Co., Ltd.)) were put in a flow mixer, FM Mixer (FM20C/I (manufactured by Nippon Coke & Engineering Co., Ltd.)), and were mixed at a temperature equal to or lower than 45° C. for 5 minutes. Subsequently, the thus obtained mixture was put and kneaded in a two open-roll continuous kneader (Kneadex MOS-160 (manufactured by Nippon Coke & Engineering Co., Ltd.)).

The thus obtained colored resin composition was cooled and then coarsely pulverized by using Turbo Mill T250 (manufacture by Freund-Turbo Corporation) to obtain a coarsely pulverized product having an average particle size of approximately 10 μm. A hundred parts by mass of the obtained coarsely pulverized product, 3.7 parts by mass of an anionic surfactant (Emal E-27C (manufactured by Kao Corporation), sodium polyoxyethylene lauryl ether sulfate, having an active ingredient concentration of 27% by mass), a 1N sodium hydroxide aqueous solution (a basic substance) in an amount shown in Table 2, and ion-exchanged water were mixed to give a slurry in a total amount of 500 parts by mass. The thus obtained slurry was put in a round bottom stainless steel pressure vessel to be subjected to shear dispersion at a rotor rotational speed of 20000 r/min for 30 minutes by using a high-speed shearing emulsifier, Clearmix (CLM-2.2S (manufactured by M Technique Co., Ltd.)) with the slurry heated and compressed at 145° C. and 0.5 MPa (G). The resultant was cooled at a rate of 5° C./min until the temperature within the stainless steel vessel became 50° C. with stirring at a rotor rotational speed of 15000 r/min Subsequently, with stirring at the same speed, the resultant was cooled at a rate of 0.5° C./min until the temperature within the stainless steel vessel became 25° C. In this manner, a colored resin fine particle dispersion was obtained.

TABLE 2

| | Colored resin fine particle dispersion | | |
|---|---|---|---|
| | A | B | C |
| Polyester resin | | | |
| Type | a | b | c |
| Acid value [mgKOH/g] | 15.5 | 10.4 | 28.9 |
| 1N sodium hydroxide aqueous solution [parts by mass] | 4.0 | 3.0 | 7.5 |

(Preparation of Release Agent Fine Particle Dispersion)

An aqueous medium dispersion of release agent fine particles was prepared by a method described below.

A hundred parts by mass of a release agent (HNP-9 (manufactured by Nippon Seiro Co., Ltd.), paraffin wax, having a melting point of 75° C.), 1 part by mass of an anionic surfactant (Emal 0 (manufactured by Kao Corporation), sodium lauryl sulfate) and ion-exchanged water were mixed to prepare a slurry in a total amount of 800 parts by mass. The obtained slurry was heated to 90° C. to melt the release agent. Thereafter, the slurry was put in a round bottom stainless steel pressure vessel to be subjected to shear dispersion at 90° C., atmospheric pressure and a rotor rotational speed of 20000 r/min for 30 minutes by using a high-speed shearing emulsifier, Clearmix (CLM-2.2S (manufactured by M Technique Co., Ltd.)). Thereafter, the resulting slurry was cooled to 25° C. at a rate of 5° C./min To the cooled slurry, a cellulose ether of a type shown in a corresponding one of Tables 3 to 6 was added and mixed in the form of a cellulose ether aqueous solution in a concentration and a content shown in the corresponding one of Tables 3 to 6. In this manner, a dispersion of release agent fine particles having an average particle size of approximately 250 nm and a solid content concentration of 20% by mass was obtained.

The following cellulose ethers a to f were used as the cellulose ether. In the following description, $DS_m$ indicates a degree of substitution with methoxy groups, $MS_{hp}$ indicates moles of substitution of hydroxypropoxy groups, and $MS_{he}$ indicates moles of substitution of hydroxyethoxy groups.

Cellulose ether a: hydroxypropyl methyl cellulose (Metolose 65SH-50 (manufactured by Shin-Etsu Chemical Co., Ltd.)) having $DS_m$ of 1.8 and $MS_{hp}$ of 0.15

Cellulose ether b: hydroxypropyl methyl cellulose (Metolose 60SH-50 (manufactured by Shin-Etsu Chemical Co., Ltd.)) having $DS_m$ of 1.9 and $MS_{hp}$ of 0.25

Cellulose ether c: hydroxypropyl methyl cellulose (Metolose 90SH-100 (manufactured by Shin-Etsu Chemical Co., Ltd.)) having $DS_m$ of 1.4 and $MS_{hp}$ of 0.20

Cellulose ether d: methyl cellulose (Metolose SM (manufactured by Shin-Etsu Chemical Co., Ltd.)) having $DS_m$ of 1.8

Cellulose ether e: hydroxyethyl methyl cellulose (Metolose SEB-04T (manufactured by Shin-Etsu Chemical Co., Ltd.)) having $DS_m$ of 1.5 and $MS_{he}$ of 0.20

Cellulose ether f: hydroxyethyl methyl cellulose (Metolose SNB-30T (manufactured by Shin-Etsu Chemical Co., Ltd.)) having $DS_m$ of 1.5 and $MS_{he}$ of 0.30

[Aggregation Step]

In a stainless steel round bottom flask with a volume of 2 L, 500 g of the colored resin fine particle dispersion and 120 g of the release agent fine particle dispersion both of types shown in the corresponding one of Tables 3 to 6 prepared as described above were put. While stirring the thus obtained mixture in the flask with an impeller at a rotational speed of 200 rpm at 25° C., a sodium hydroxide aqueous solution was added thereto to adjust the mixture in the flask to pH 10. Thereafter, the mixture was continuously stirred for 10 minutes. Subsequently, an aqueous solution of an aggregating agent of a type shown in the corresponding one of Tables 3 to 6 was added dropwise to the flask over 5 minutes, so that the concentration of the aggregating agent in the mixture in the flask can be a concentration shown in the corresponding one of Tables 3 to 6. Then, the resulting mixture in the flask was heated at a temperature increasing rate of 0.2° C./min, thereby starting aggregation of the colored resin fine particles and the release agent fine particles. After stopping heating at 40° C., the mixture in the flask was kept at 40° C. for 30 minutes under stirring, so as to allow the aggregation of the colored resin fine particles and the release agent fine particles to proceed. Thereafter, 50 g of a sodium chloride aqueous solution in a concentration of 20% by mass was added into the flask to stop the aggregation of the fine particles, and thus, an aqueous medium dispersion of fine particle aggregates was obtained.

[Coalescence Step]

The resulting aqueous medium dispersion of fine particle aggregates was heated to 72° C. at a temperature increasing rate of 0.2° C./min After heating to 72° C., the dispersion was stirred at this temperature for 2 hours, so as to coalesce toner components contained in the fine particle aggregates and to make the fine particle aggregates spherical. Thereafter, the aqueous medium dispersion of the fine particle aggregates thus coalesced was cooled to 25° C. at a rate of 10° C./min, so as to obtain a toner mother particle dispersion containing the coalesced fine particle aggregates as toner mother particles.

In Comparative Examples 1 to 3, fine particle aggregates were aggregated with each other to form coarse particles in the coalescence step, and hence, toner mother particles with a desired particle size could not be obtained. This is probably because the release agent came off and the fine particle aggregates were aggregated with each other via the release agent thus having come off in the coalescence step. Accordingly, in Comparative Examples 1 to 3, the washing step, the drying step and evaluation of the toner described below were not performed.

In Comparative Example 4, the aggregation did not sufficiently proceed in the aggregation step, and hence, toner mother particles with a desired particle size could not be obtained after the coalescence step. This is probably because sodium chloride, which is poorer in performance to aggregate fine particles than an alkali metal sulfate, was used as the aggregating agent. Therefore, in Comparative Example 4, the washing step, the drying step and evaluation of the toner described below were not performed.

(Washing Step and Drying Step)

A wet cake of the toner mother particles was filtered out by using a Buchner funnel from the toner mother particle dispersion. The wet cake of the toner mother particles was dispersed again in ion-exchanged water for washing the toner mother particles. The washing of the toner mother particles thus using ion-exchanged water was similarly repeated five times. After the washing, the wet cake of the toner mother particles was vacuum dried at 40° C. to obtain toner mother particles.

(External Addition Step)

A hundred parts by mass of the toner mother particles and 2.0 parts by mass of an external additive (H30TA (manufactured by Wacker Chemie Ag)) were mixed for 5 minutes by using a Henschel mixer with a volume of 5 L (manufactured by Nippon Coke & Engineering Co., Ltd.), thereby adhering the external additive to the surfaces of the toner mother particles to obtain a toner. Thereafter, the toner was sifted by using a 300-mesh sieve (having a sieve opening of 48 μm).

The volume average particle size ($D_{50}$) of the toner particles obtained in each of Examples 1 to 13 was measured by using a particle size distribution analyzer (Microtrac UPA 150 (manufactured by Nikkiso Co., Ltd.)). Besides, the average roundness of the toner particles obtained in each of Examples 1 to 13 was measured by using FPIA-3000 (manufactured by Sysmex Corporation). The measurement results of the volume average particle size ($D_{50}$) and the average roundness of the toner particles obtained in each of Examples 1 to 13 are shown in Tables 3 to 5.

<<Evaluation 1>>

The toner obtained in each of Examples 1 to 13 was used for evaluating the high-temperature storage resistance by a method described below. The results of the evaluation of the high-temperature storage resistance of the toners of Examples 1 to 13 are shown in Tables 3 to 5.

<Evaluation of High-temperature Storage Resistance>

Ten g of the toner was allowed to stand still for 8 hours in an incubator set to 60° C. Thereafter, the 10 g of the toner having been stored in the incubator was placed on a sieve having a sieve opening of 45 μm, and the sieve was shook for 60 seconds under a condition of an amplitude of vibration of 1 mm by using a powder tester (manufactured by Hosokawa Micron KK) so as to sift the toner. After the sifting, the mass (T (g)) of the toner remaining on the 45 μm-sieve was weighed, so as to calculate the degree of aggregation of the toner in accordance with the following formula:

$$\text{Degree of aggregation of toner (\%)}=(T/10)\times 100$$

The high-temperature storage resistance was evaluated based on the following criteria:

Good (G): The degree of aggregation of the toner was less than 10%.

Poor (P): The degree of aggregation of the toner was 10% or more.

<<Evaluation 2>>

The toner obtained in each of Examples 1 to 13 was used for evaluating the fixability by a method described below. For the evaluation of the fixability, a modified apparatus (specifically, modified so that a fixing temperature of a fixing unit could be controlled within a temperature range for a fixing test) of a color printer (FS-C5400DN (manufactured by Kyocera Document Solutions Inc.)) was used. A recording medium was plain paper. The fixability was evaluated by using a two-component developer prepared by a method described below. The evaluation results of the toners of Examples 1 to 13 are shown in Tables 3 to 5.

Preparation Example 2

(Preparation of Carrier)

Respective raw materials were mixed so as to obtain composition ratios of 39.7 mol % in terms of MnO, 9.9 mol % in terms of MgO, 49.6 mol % in terms of $Fe_2O_3$ and 0.8 mol % in terms of SrO, water was added to the resulting mixture, and the resultant was pulverized and mixed by a wet ball mill over 10 hours. The thus obtained mixture was dried and retained at 950° C. for 4 hours. Subsequently, the mixture was pulverized by a wet ball mill over 24 hours to prepare a slurry. The slurry was granulated and dried, the granulated product was retained in an atmosphere of oxygen concentration of 2% at 1270° C. for 6 hours, and the resultant was crushed and adjusted for particle size, thereby obtaining manganese-based ferrite particles (carrier cores). The manganese-based ferrite particles thus obtained had an average particle size of 35 μm and a saturation magnetization of 70 $Am^2/kg$ in an applied magnetic field of 3,000 ($10^3/4\pi\cdot A/m$).

Then, a polyamide imide resin (i.e., a copolymer of trimellitic acid anhydride and 4,4'-diaminodiphenylmethane) was diluted with methyl ethyl ketone to prepare a resin solution. A tetrafluoroethylene-hexafluoropropylene copolymer (FEP) and silicon oxide (in an amount of 2% by mass based on the whole resin amount) were dispersed in the resin solution to obtain a carrier coating solution in an amount of 150 g in terms of solid content. The ratio in mass between the polyamide imide resin and the FEP was 2/8 (polyamide imide resin/FEP). The solid content ratio of the resin solution was 10% by mass.

Ten kg of the manganese-based ferrite particles were coated with the obtained carrier coating solution by a flow bed coating apparatus (Spiracoater SP-25 (manufactured by Okada Seiko Co., Ltd.)). Thereafter, the manganese-based ferrite particles coated with the resin were sintered at 220° C. for 1 hour, so as to obtain a resin-coated ferrite carrier containing 1.5% by mass of the coating resin.

(Preparation of Two-Component Developer)

A two-component developer was prepared by mixing the thus obtained resin-coated ferrite carrier with the toner of each of Examples 1 to 13 to attain a toner concentration of 10% by mass in the two-component developer.

<Evaluation Method for Fixability>

The two-component developer was filled in a developing unit of a color printer, the toner was filled in a toner cartridge, and then, an unfixed image having a toner placement amount of 0.5 $mg/cm^2$ on a recording medium was formed. Subsequently, the unfixed image was fixed with the fixing temperature changed in a range from 80° C. to 180° C. inclusive, so as to measure the lowest fixable temperature and the highest fixable temperature at which no offset was caused.

(Evaluation of Low-temperature Fixability)

The low-temperature fixability was evaluated based on the following criteria:

Good (G): The lowest fixable temperature was lower than 120° C.

Poor (P): The lowest fixable temperature was 120° C. or more.

(Evaluation of Fixable Temperature Range)

A fixable temperature range corresponding to a difference between the lowest fixable temperature and the highest fixable temperature (i.e., the highest fixable temperature—the lowest fixable temperature) was calculated, and the fixable temperature range was evaluated based on the following criteria:

Good (G): The fixable temperature range was 50° C. or more.

Poor (P): The fixable temperature range was less than 50° C.

TABLE 3

| | Example | | | | |
|---|---|---|---|---|---|
| | 1 | 2 | 3 | 4 | 5 |
| Release agent fine particle dispersion | | | | | |
| Cellulose ether | | | | | |
| Type | a | b | c | a | a |
| Degree of substitution with methoxy groups ($DS_m$) | 1.8 | 1.9 | 1.4 | 1.8 | 1.8 |
| Moles of substitution of hydroxypropoxy groups ($MS_{hp}$) | 0.15 | 0.25 | 0.20 | 0.15 | 0.15 |

TABLE 3-continued

| | Example | | | | |
|---|---|---|---|---|---|
| | 1 | 2 | 3 | 4 | 5 |
| Moles of substitution of hydroxyethoxy groups ($MS_{he}$) | — | — | — | — | — |
| Concentration [% by mass] | 10.0 | 10.0 | 10.0 | 10.0 | 10.0 |
| Content [parts by mass] | 100 | 100 | 100 | 100 | 100 |
| Colored resin fine particle dispersion | | | | | |
| Type | A | A | A | A | A |
| Acid value of polyester resin [mgKOH/g] | 15.5 | 15.5 | 15.5 | 15.5 | 15.5 |
| Aggregating agent | | | | | |
| Type | Sodium sulfate | Sodium sulfate | Sodium sulfate | Sodium sulfate | Sodium sulfate |
| Concentration in dispersion [% by mass] | 1.0 | 1.0 | 1.0 | 0.5 | 5.0 |
| Measurement results | | | | | |
| Volume average particle size ($D_{50}$) [μm] | 5.8 | 5.9 | 5.8 | 5.9 | 5.8 |
| Average roundness | 0.978 | 0.976 | 0.975 | 0.980 | 0.978 |
| Evaluation results | | | | | |
| High-temperature storage resistance | | | | | |
| Degree of aggregation [%] | 6.5 | 5.7 | 5.8 | 3.0 | 7.5 |
| Evaluation | G | G | G | G | G |
| Fixability | | | | | |
| Lowest fixable temp. [° C.] | 115 | 115 | 110 | 118 | 118 |
| Evaluation | G | G | G | G | G |
| Fixable temp. range [° C.] | 60 | 60 | 65 | 65 | 65 |
| Evaluation | G | G | G | G | G |

TABLE 4

| | Example | | | | |
|---|---|---|---|---|---|
| | 6 | 7 | 8 | 9 | 10 |
| Release agent fine particle dispersion | | | | | |
| Cellulose ether | | | | | |
| Type | a | b | c | a | b |
| Degree of substitution with methoxy groups ($DS_m$) | 1.8 | 1.9 | 1.4 | 1.8 | 1.9 |
| Moles of substitution of hydroxypropoxy groups ($MS_{hp}$) | 0.15 | 0.25 | 0.20 | 0.15 | 0.25 |
| Moles of substitution of hydroxyethoxy groups ($MS_{he}$) | — | — | — | — | — |
| Concentration [% by mass] | 10.0 | 10.0 | 10.0 | 10.0 | 10.0 |
| Content [parts by mass] | 100 | 100 | 100 | 100 | 100 |
| Colored resin fine particle dispersion | | | | | |
| Type | B | C | A | B | C |
| Acid value of polyester resin [mgKOH/g] | 10.4 | 28.9 | 15.5 | 10.4 | 28.9 |

TABLE 4-continued

| | Example | | | | |
|---|---|---|---|---|---|
| | 6 | 7 | 8 | 9 | 10 |
| Aggregating agent | | | | | |
| Type | Sodium sulfate | Sodium sulfate | Potas-sium sulfate | Potas-sium sulfate | Potas-sium sulfate |
| Concentration in dispersion [% by mass] | 1.0 | 1.0 | 1.0 | 1.0 | 1.0 |
| Measurement results | | | | | |
| Volume average particle size ($D_{50}$) [μm] | 5.8 | 5.8 | 5.8 | 5.8 | 5.9 |
| Average roundness | 0.978 | 0.976 | 0.979 | 0.981 | 0.980 |
| Evaluation results | | | | | |
| High-temperature storage resistance | | | | | |
| Degree of aggregation [%] | 3.5 | 3.8 | 4.1 | 3.8 | 3.8 |
| Evaluation | G | G | G | G | G |
| Fixability | | | | | |
| Lowest fixable temp. [° C.] | 115 | 115 | 116 | 118 | 116 |
| Evaluation | G | G | G | G | G |
| Fixable temp. range [° C.] | 65 | 65 | 60 | 60 | 60 |
| Evaluation | G | G | G | G | G |

TABLE 5

| | Example | | |
|---|---|---|---|
| | 11 | 12 | 13 |
| Release agent fine particle dispersion | | | |
| Cellulose ether | | | |
| Type | c | a | b |
| Degree of substitution with methoxy groups ($DS_m$) | 1.4 | 1.8 | 1.9 |
| Moles of substitution of hydroxypropoxy groups ($MS_{hp}$) | 0.20 | 0.15 | 0.25 |
| Moles of substitution of hydroxyethoxy groups ($MS_{he}$) | — | — | — |
| Concentration [% by mass] | 2.5 | 2.5 | 2.5 |
| Content [parts by mass] | 80 | 80 | 80 |
| Colored resin fine particle dispersion | | | |
| Type | A | B | C |
| Acid value of polyester resin [mgKOH/g] | 15.5 | 10.4 | 28.9 |
| Aggregating agent | | | |
| Type | Sodium sulfate | Sodium sulfate | Sodium sulfate |
| Concentration in dispersion [% by mass] | 1.0 | 1.0 | 1.0 |
| Measurement results | | | |
| Volume average particle size ($D_{50}$) [μm] | 5.8 | 5.8 | 5.9 |
| Average roundness | 0.977 | 0.977 | 0.981 |
| Evaluation results | | | |
| High-temperature storage resistance | | | |
| Degree of aggregation [%] | 3.5 | 4.2 | 6.1 |
| Evaluation | G | G | G |
| Fixability | | | |
| Lowest fixable temp. [° C.] | 115 | 115 | 115 |
| Evaluation | G | G | G |

TABLE 5-continued

| | Example | | |
|---|---|---|---|
| | 11 | 12 | 13 |
| Fixable temp. range [° C.] | 65 | 65 | 65 |
| Evaluation | G | G | G |

TABLE 6

| | Comparative Example | | | |
|---|---|---|---|---|
| | 1 | 2 | 3 | 4 |
| Release agent fine particle dispersion | | | | |
| Cellulose ether | | | | |
| Type | d | e | f | a |
| Degree of substitution with methoxy groups ($DS_m$) | 1.8 | 1.5 | 1.5 | 1.8 |
| Moles of substitution of hydroxypropoxy groups ($MS_{hp}$) | — | — | — | 0.15 |
| Moles of substitution of hydroxyethoxy groups ($MS_{he}$) | — | 0.2 | 0.3 | — |
| Concentration [% by mass] | 10.0 | 10.0 | 10.0 | 10.0 |
| Content [parts by mass] | 100 | 100 | 100 | 100 |
| Colored resin fine particle dispersion | | | | |
| Type | A | A | A | A |
| Acid value of polyester resin [mgKOH/g] | 15.5 | 15.5 | 15.5 | 15.5 |
| Aggregating agent | | | | |
| Type | Sodium sulfate | Sodium sulfate | Sodium sulfate | Sodium chloride |
| Concentration in dispersion [% by mass] | 1.0 | 1.0 | 1.0 | 1.0 |

On the basis of the results obtained in Examples 1 to 13, the following can be understood: If toner particles included in a toner are produced by a production method including: (I) an aggregation step of forming fine particle aggregates by aggregating fine particles containing a binder resin and fine particles containing a release agent in an aqueous medium in the presence of an aggregating agent containing an alkali metal sulfate; and (II) a coalescence step of forming the toner particles by coalescing components contained in the fine particle aggregates in an aqueous medium in the presence of hydroxypropyl methyl cellulose, the resultant toner contains a large amount of the release agent in the binder resin, and has excellent fixability over a wide temperature range including a low-temperature region.

What is claimed is:

1. A method for producing an electrostatic latent image developing toner including a plurality of toner particles, comprising:

(I) aggregation of forming fine particle aggregates by aggregating fine particles containing a binder resin and fine particles containing a release agent in an aqueous medium in the presence of an aggregating agent containing an alkali metal sulfate; and (II) coalescence of forming the toner particles by coalescing components contained in the fine particle aggregates in an aqueous medium in the presence of hydroxypropyl methyl cellulose, wherein the aggregation includes providing a first dispersion of the fine particles containing the binder resin in a first aqueous medium, providing a second dispersion of the fine particles containing the release agent in a second aqueous medium, the second dispersion containing the hydroxypropyl methyl cellulose, combining the first dispersion and the second dispersion to form a mixture, and adding the alkali metal sulfate to the mixture of the first dispersion and the second dispersion.

2. A method for producing an electrostatic latent image developing toner according to claim 1, wherein the hydroxypropyl methyl cellulose has a degree of substitution with methoxy groups ($DS_m$) of 1.4 or more and 1.9 or less, and moles of substitution of hydroxypropoxy groups ($MS_{hp}$) of 0.15 or more.

3. A method for producing an electrostatic latent image developing toner according to claim 1, wherein a concentration of the hydroxypropyl methyl cellulose in the aqueous medium in which the fine particle aggregates are formed is 0.5% by mass or more and 5.0% by mass or less based on a total mass of liquid components contained in the aqueous medium in which the fine particle aggregates are formed.

4. A method for producing an electrostatic latent image developing toner according to claim 1, wherein the aggregating agent is sodium sulfate.

* * * * *